United States Patent [19]

Clark et al.

[11] 4,176,690

[45] Dec. 4, 1979

[54] REGULATOR FOR A DAMPER ASSEMBLY

[75] Inventors: William E. Clark, Syracuse; Carl C. Herb, Camillus, both of N.Y.

[73] Assignee: Carrier Corporation, Syracuse, N.Y.

[21] Appl. No.: 858,141

[22] Filed: Dec. 7, 1977

[51] Int. Cl.[2] ..... G05D 7/01

[52] U.S. Cl. ..... 137/8; 137/504; 137/505.13; 137/505.14

[58] Field of Search ..... 137/497, 499, 505.13, 137/505.14, 504, 8; 236/49

[56] References Cited

U.S. PATENT DOCUMENTS

| | | | |
|---|---|---|---|
| 3,191,615 | 6/1965 | Edwards | 137/504 X |
| 3,506,038 | 4/1970 | Perry | 137/521 X |
| 3,845,783 | 11/1974 | Lepeleire | 137/504 |
| 3,958,605 | 5/1976 | Nishizu | 137/504 X |

*Primary Examiner*—Robert G. Nilson

*Attorney, Agent, or Firm*—J. Raymond Curtin; Barry E. Deutsch

[57] ABSTRACT

A regulator for a damper assembly operable to control the flow of conditioned air through a supply duct. The regulator includes a pressure responsive member connected to the damper assembly to vary the position thereof within the supply duct in accordance with changes in the conditioned air supply pressure to maintain a substantially constant volume air flow downstream of the damper assembly irrespective of such changes. The regulator further includes control point setting means for obtaining the level of constant volume air flow including force generating elements acting in opposition to the pressure responsive member for providing a first force at a maximum level of constant volume air flow and for further providing a second force at lesser levels of constant volume air flow.

13 Claims, 3 Drawing Figures

REGULATOR FOR A DAMPER ASSEMBLY

BACKGROUND OF THE INVENTION

This invention relates to constant volume flow controls of the type used to maintain a relatively constant rate of discharge from a terminal of an air distribution system or the like, and more particularly to an improved regulator for a damper assembly operable to control the flow of conditioned air whereby the regulator has a relatively large operational range of constant volume settings.

Many multi-room structures, such as office buildings and schools, constructed during the past several years include air conditioning systems to deliver either relatively warm or cool conditioned air from a central source thereof to each of the enclosures or rooms in the building. Typically, one or more ducts are employed to deliver the air to each enclosure. Very often a damper assembly or similar mechanism is installed in the duct to regulate the flow of air to one or more diffusers or discharge outlets located in the enclosure being conditioned by the discharge of air thereinto. The movement of the damper assembly may be responsive to changes in the conditioned air supply pressure and/or changes in the temperature of the enclosure. The controls regulating movement of the damper assembly typically include control point setting means establishing a maximum level of conditioned air flow irrespective of changes in the supply air pressure.

Constant volume flow controls of various constructions employed with air conditioning systems of the above-described type are well known in the art. Very often, a spring or similar force generating means is employed in obtaining the predetermined volume flow setting. One of the shortcomings of the prior art devices is that with a particular spring, the control point setting means is only effective over a relatively narrow range of flow rates. When rates outside of that range are to be accommodated, it is necessary to substitute a spring of a different characteristic for the spring already used.

In U.S. Pat. No. 3,506,038, issued in the names of Leo F. Perry and Joseph W. Spradling, an attempt has been made to solve the problem. The cited United States patent discloses the use of a first torsional spring to generate a force opposing the movement of the damper assembly. A second torsional spring is used to generate a force on a valve blade. The valve blade is movable relative to the damper assembly. The position of the valve blade determines the constant volume flow setting for the system. The disclosed arrangement has an operating range of 250–500 cfm, or a 50% control range. However, in some applications, it has been found advantageous to have a much greater range than the 50% range available through the arrangement of the prior art patent. For example, in some applications, a useful control range of 50 to 500 cfm is required. With the arrangement disclosed in the cited patent, it would be necessary to substitute two pairs of springs having different characteristics to obtain the same operating range as that achieved via the present invention.

SUMMARY OF THE INVENTION

It is accordingly an object of this invention to provide a regulator for a damper assembly operable through a relatively broad control range.

It is a further object of this invention to provide a regulator having novel control point setting means.

It is a further object of this invention to include a regulator for a damper assembly having first force generating means operable at a maximum level of constant volume air flow and second force generating means operable when the level of constant volume air flow is varied.

It is a further object of this invention to provide a regulator for a damper assembly whereby the distance the damper assembly is moved in response to an identical change in supply air pressure is decreased as the level of constant volume air flow is decreased.

These and other objects of the present invention are attained in a regulator for a damper assembly operable to control the flow of conditioned air through a supply duct. Pressure responsive means is connected to the damper assembly to vary the position thereof within the supply duct in accordance with changes in the conditioned air supply pressure to maintain a substantially constant volume air flow downstream of the damper assembly irrespective of the changes in supply pressure. The regulator further includes control point setting means for determining the level of constant volume air flow. The control point setting means includes first force generating means acting in opposition to the pressure responsive means to restrain movement of the damper assembly at a first constant volume air flow setting, and second force generating means acting in opposition to the pressure responsive means to further restrain movement of the damper assembly when the level of constant volume air flow is reduced.

DESCRIPTION OF THE PREFERRED EMBODIMENT

Figure 1:
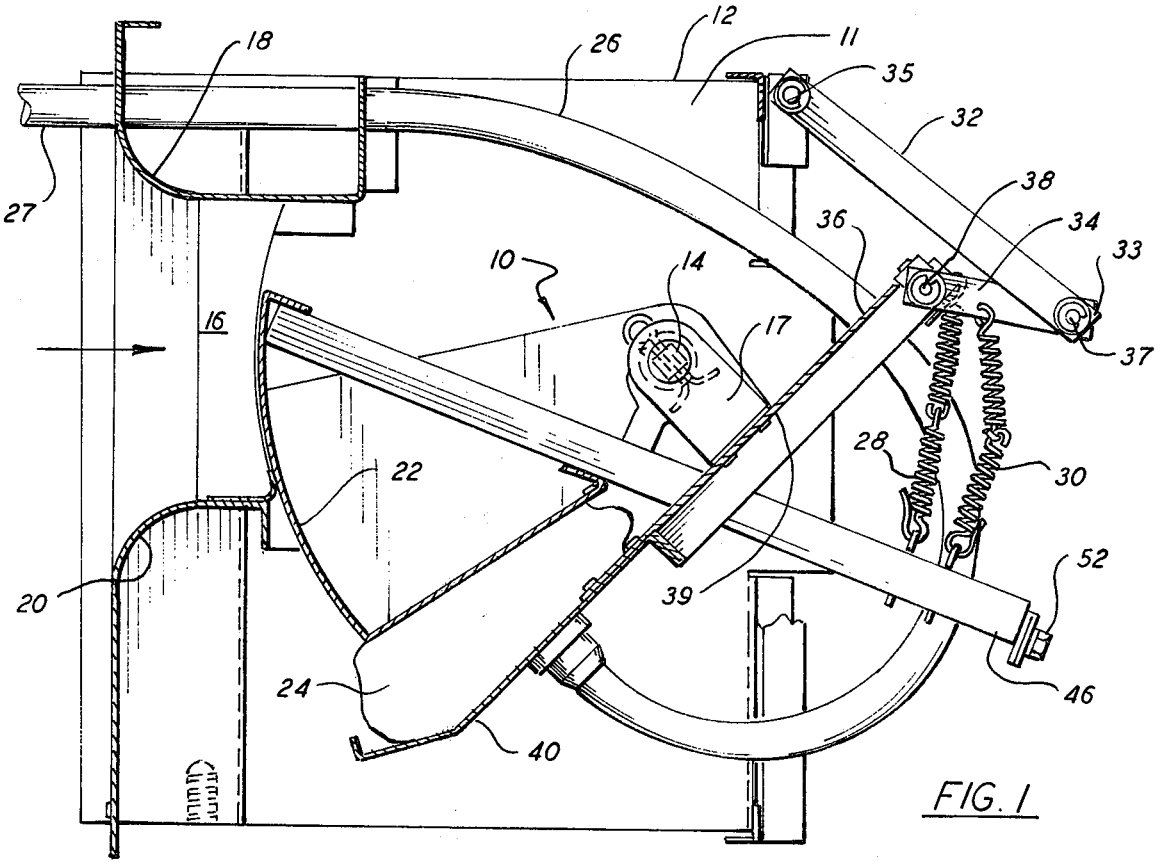
FIG. 1 is a sectional view through a supply duct illustrating the damper assembly and regulator of the present invention with the damper assembly shown in a first operating position.

Referring now to the drawings, there is disclosed a preferred embodiment of the present invention. The invention relates to a regulator to control the flow of conditioned air through a supply duct. Reference may be had to copending United States patent applications, Ser. No. 858,140, filed Dec. 7, 1977, in the names of William Clark, Carl Herb, and Reginald Greene; and Ser. No. 858,142, filed Dec. 7, 1977, in the name of Carl Herb and assigned to the same assignee as the assignee hereof for further details relating to the damper assembly and the pressure responsive control for such damper assembly.

FIG. 1 illustrates a damper blade assembly 10 installed in a supply duct 12. The assembly is rotatable about a rod 14 which extends laterally between the spaced vertical sides, (only one of which is shown), of the supply duct 12. Assembly 10 turns freely about rod or shaft 14. Damper assembly 10 regulates the flow of conditioned air through an opening 16 defined between inlet plates 18 and 20.

Damper blade assembly 10 includes a damper blade 22. Blade 22 rotates in response to pressure responsive control member 24. Member 24 may be an inflatable bellows or bladder, the inflation thereof being in direct relationship with the pressure of the supply air upstream of inlet plates 18 and 20. Inflation of bladder 24 will be regulated by the air flow through tube 26 having an air inlet 27. Inflation of the bladder in accordance with changes in supply air pressure will maintain a constant level of conditioned air flow downstream of the cutoff plates irrespective of such supply air pressure changes. Inflation of bladder 24 varies directly with changes in the upstream supply air pressure. Thus, as the pressure of the air increases, the inflation of bladder 24 will increase to rotate damper assembly 10 in a clockwise direction to reduce the active size of opening 16. Similarly, as the upstream air pressure decreases, bladder 24 will deflate, resulting in the damper rotating in a counterclockwise direction to increase the active size of opening 16. Thus, a substantially constant volume of air will be discharged through supply duct 12 to various terminals or diffusers located in a space or spaces being conditioned.

Damper assembly 10 is designed to regulate the flow of air wherein the supply air pressure may vary from one inch w.g. to five inches w.g. In addition, it is desirable to have the damper assembly regulate the flow of air at various levels of constant volume air flow, as for example from 50 cfm through 500 cfm. Thus, it is necessary that a regulator for the damper assembly be provided to permit the pressure responsive bladder 24 to effect proper movement of damper assembly 10 for any pressure change within the pressure levels of from one inch to five inches irrespective of the constant volume flow setting actually required.

To achieve the foregoing, the present invention provides control point setting means to obtain the level of constant volume air flow irrespective of the actual supply air pressure upstream of opening 16. The control point setting means includes first and second force generating means illustrated as primary spring 28 and secondary spring 30. The springs are suitably attached to a linkage system comprising link arms 32, 34, and 36. Arm 32 is rotatably attached to pin 35. The pin is secured to the inside of side wall 11 of duct 12, as for example by suitable bolts and nuts. Link arm 34 is rotatably attached to pin 37 provided in the end 33 of link 32. Arm 36 is pivotally attached to arm 34 at point 38. Arm 36 is a generally U-shaped member and includes a flange-like surface 39. Support bracket 17 connects member 36 to shaft 14. A second member 40 is affixed to member 39 and defines an axial extension thereof.

Bladder 24 is affixed to member 40 and is disposed between upper surface 42 of member 40 and lower surface 44 of damper blade 22. The angular position of member 40 within the supply duct determines the constant volume level of air flow downstream of opening 16.

For example, the initial setting of member 40 is changed by either rotating the member clockwise or counterclockwise toward or away from upper plate 18 if it is respectively desired to decrease or increase the level of constant volume air flow through opening 16.

One end of primary spring 28 is secured to arm 36, with one end of secondary spring 30 being secured to arm 34. The other end of each of the springs is secured to a member 46 connected to damper blade 22. The springs provide a restraining force on damper blade assembly 10 in opposition to the force developed thereon by bladder 24. In effect, the restraining force generated by springs 28 and 30 permits the bladder to move the damper blade assembly in actual relationship with the desired constant volume air flow setting. In the absence of any restraining force, any inflation of bladder 24 would result in free rotation of damper blade 22 in a clockwise direction.

In operation, when maximum level of constant volume air flow is desired, primary spring 28 provides the only restraining force on damper assembly 10. The maximum level of air flow may be, for example 500 cfm. At this point, members 36 and 40 are rotated in a counterclockwise direction so that maximum air flow through opening 16 may be obtained. The initial position of members 36 and 40 for a given constant volume flow setting is established by means not shown, as for example a pneumatic actuator responsive to a room thermostat and operatively connected to shaft 14. The damper blade assembly 10 is initially positioned so that a maximum air flow setting is obtained at minimum pressure levels, as for example one inch w.g. At this point, if the pressure should increase, inflation of the bladder will increase to rotate assembly 10 in a clockwise direction with the degree of rotation varying directly with the increase in supply air pressure upstream of opening 16. Primary spring 28 is stretched due to the rotational movement of member 46 to which it is attached, with its force thus increasing as the damper blade assembly rotates in a clockwise direction. At the maximum flow setting, spring 28 provides the only restraining force required to prevent unrestrained damper blade assembly movement as the position of lever 34 maintains spring 30 in its relaxed or inoperative state as illustrated in FIG. 1.

At flow settings less than maximum, i.e. at any point from 50 through 450 cfm, members 36 and 40 and bladder 24 are initially positioned by rotating members 36 and 40 within supply duct 12 in a clockwise direction. The actual initial position of members 36 and 40 is determined by the desired constant volume flow setting as established, for example through a room thermostat.

Figure 2:
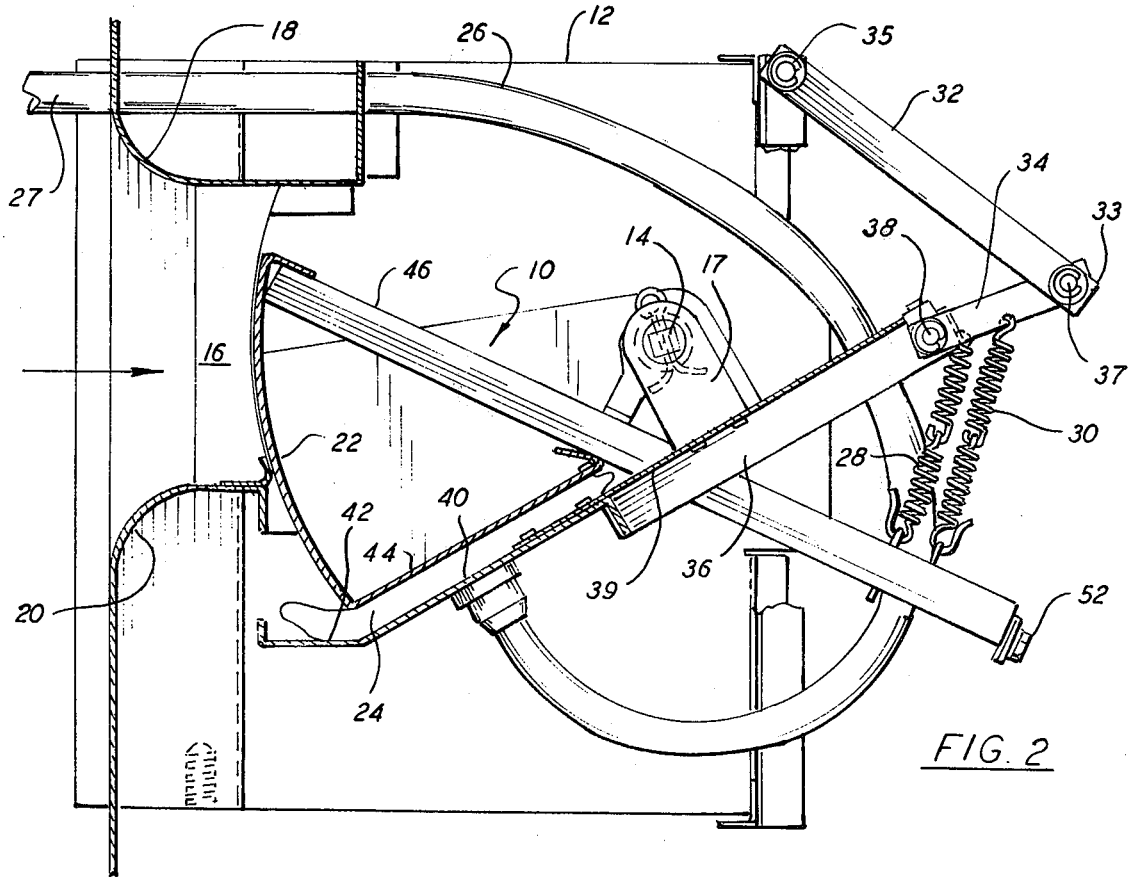
FIG. 2 is a sectional view similar to FIG. 1, but illustrating the damper assembly in a second operating position.

As clearly shown in FIG. 2, at lower flow settings, arms 36 and 40 are rotated clockwise toward plate 18. Lever arm 34 is thus rotated about point 38 in a direction such that secondary spring 30 provides a restraining force on the damper blade assembly in addition to the restraining force provided by spring 28 as described above. In effect, the movement of arm 34 activates the secondary spring. Thus, at minimum flow pressure and a constant volume level less than maximum, the size of fluid flow opening 16 is somewhat decreased. As the pressure in the supply air duct upstream of opening 16 increases, bladder 24 is inflated thereby rotating the damper blade assembly, including member 46, in a clockwise direction. This causes the primary and secondary springs 28 and 30 to be further stretched thereby increasing the force generated by such springs. Thus, once secondary spring 30 is made operative as a result of the initial location of members 36 and 40 within duct 12, there is less angular movement of the damper blade assembly for the same change in supply air pressure. That is to say, at lower flow settings the damper blade assembly will move through a smaller angular distance for the same change in supply air pressure. FIG. 2 illustrates the manner in which both springs 28 and 30 are stretched as assembly 10, including member 46, rotates toward plate 18.

In effect, at maximum flow setting, spring 28 by itself develops the restraining force on assembly 10 to regulate movement thereof in accordance with inflation of bladder 24 to maintain a constant volume flow setting. The force generated by spring 28 will increase as the blade assembly 10 rotates in a clockwise direction, thereby stretching the spring.

At lower levels of constant volume flow settings, spring 30 generates an additive force to the force generated by spring 28. By providing the additional restraining force, the rotational movement of blade assembly 10 will be reduced for a given supply air pressure change as compared to the movement of the assembly at the maximum constant volume flow setting and the same pressure change.

Figure 3:
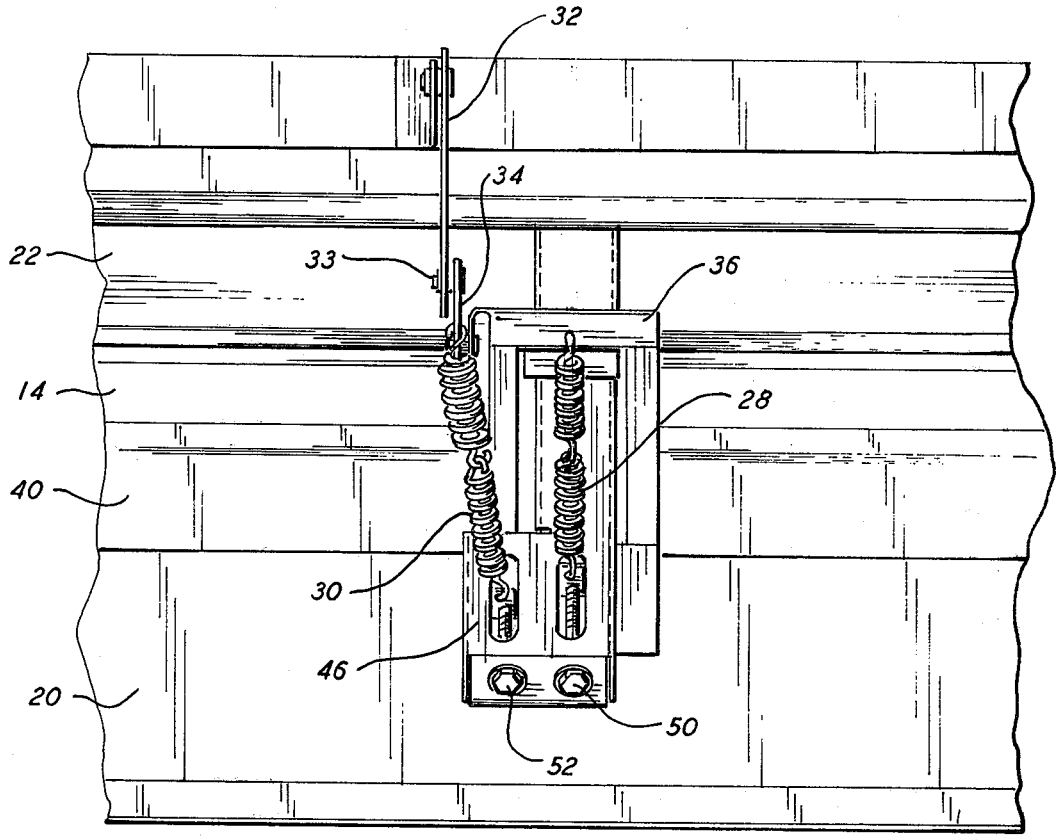
FIG. 3 is an end view of the damper assembly and regulator illustrating further details of the present invention.

With reference to FIG. 3, it will be observed that each of the springs 28 and 30 are attached to rotatable screws 50 and 52 which pass through the end of member 46. Screws 50 and 52 are adjustable to provide initial tension adjustments on the springs to compensate for tolerance variations.

The regulator thus described for the damper blade assembly provides a relatively simple and inexpensive mechanism to effectively control the constant volume flow of air through the supply duct at all levels of constant volume flow settings, irrespective of variations in the pressure of the supply air.

While a preferred embodiment of the present invention has been described and illustrated, the invention should not be limited thereto, but may be otherwise embodied within the scope of the following claims.

We claim:

1. A regulator for a damper assembly operable to control the flow of conditioned air through a supply duct comprising:

pressure responsive means connected to said damper assembly to vary the position thereof within said supply duct in accordance with changes in the conditioned air supply pressure to maintain a substantially constant volume air flow downstream of said damper assembly irrespective of such changes; and control point setting means for obtaining the level of constant volume air flow including a first force generating means for providing a first force acting in opposition to said pressure responsive means to restrain movement of said damper assembly at a first constant volume flow setting, second force generating means for providing a second force acting in opposition to said pressure responsive means to further restrain movement of said damper assembly when the level of constant volume air flow is reduced, and force adding means operable at said reduced volume of air flow for combining said first and second forces for restraining movement of said damper assembly.

2. A regulator in accordance with claim 1 wherein said control point setting means includes a rotatable member attached to said damper assembly and positioned within the flow path of said conditioned air through said duct, the angular position thereof within said duct determining the level of constant volume air flow.

3. A regulator in accordance with claim 2 wherein said second force generating means is inoperative at a maximum constant volume air flow setting.

4. A regulator in accordance with claim 1 wherein said second force generating means is inoperative at a maximum constant volume air flow setting.

5. A regulator for a damper assembly operable to control the flow of conditioned air through a supply duct comprising:

pressure responsive means connected to said damper assembly to vary the position thereof within said supply duct in accordance with changes in the conditioned air supply pressure to maintain a substantially constant volume air flow downstream of said damper assembly irrespective of such changes; and control point setting means for obtaining the level of constant volume air flow including force generating means acting in opposition to said pressure responsive means for providing a first force at a maximum level of constant volume air flow, and further providing a second force at lesser levels of constant volume air flow, the distance said damper assembly is moved by said pressure responsive means for the same change in supply air pressure is decreased as the level of said constant volume air flow is decreased, further including means for combining said first and second forces at said lesser levels of constant volume air flow for restraining movement of said damper assembly.

6. A regulator in accordance with claim 5 wherein said control point setting means includes a rotatable member attached to said damper assembly and positioned within the flow path of said conditioned air through said duct, the angular position thereof within said duct determining the level of constant volume air flow.

7. A regulator in accordance with claim 6 including means to prevent generation of said second force at the maximum constant volume air flow setting.

8. A regulator for a damper assembly in accordance with claim 5 including means to prevent generation of said second force at the maximum constant volume air flow setting.

9. A regulator for a damper assembly operable to control the flow of conditioned air through a supply duct comprising:

pressure responsive means connected to said damper assembly to vary the position thereof within said supply duct in accordance with changes in the conditioned air supply pressure to maintain a substantially constant volume air flow downstream of said damper assembly irrespective of such changes; and control point setting means for obtaining the level of constant volume air flow including first force generating means acting in opposition to said pressure responsive means to restrain movement of said damper assembly at a first constant volume flow setting, the magnitude of said first force increasing substantially at a constant rate in direct proportion to the rate of increase of said conditioned air supply pressure, and second force generating means acting in opposition to said pressure responsive means to further restrain movement of said damper assembly when the level of constant volume air flow is reduced, the magnitude of said second force increasing substantially at a constant rate in direct proportion to the rate of increase of said conditioned air supply pressure, and force adding means operable at said reduced constant volume air flow level for combining said first and second forces for restraining movement of said damper assembly.

10. A damper assembly operable to control the flow of conditioned air through a supply duct comprising:

a damper blade rotatably positioned within said supply duct;

pressure responsive means connected to said damper blade to vary the position thereof within said supply duct in accordance with changes in the conditioned air supply pressure to maintain a substantially constant volume air flow downstream of said damper blade irrespective of such changes;

a rotatable member connected to said pressure responsive means and positioned within the flow path of said conditioned air through said duct, the angular position thereof within said duct determining the level of constant volume air flow; and control point setting means to regulate the level of constant volume air flow including a primary spring operable to generate a force to restrain movement of said damper blade at a first constant volume flow setting, and having one end attached to said rotatable member and the other end thereof attached to said damper blade, movement of said damper blade in response to said pressure responsive means relative to said rotatable member increasing the force generated by said primary spring, and a secondary spring operable to generate a second force to further restrain movement of said damper blade when the level of constant volume air flow is reduced by rotation of said rotatable member, said secondary spring having one end attached to said damper blade and its other end secured to a lever arm, the lever arm in turn being attached to said rotatable member, the interconnection between said lever arm, said secondary spring and said rotatable member maintaining said secondary spring in a relaxed state at said first constant volume air flow setting, said secondary spring becoming active at said reduced levels of constant volume air flow, movement of said damper blade relative to said rotatable member at reduced levels of constant volume air flow increasing the force generated by said primary and secondary springs.

11. A damper assembly in accordance with claim 10 further including tension adjusting means connected to one end of each of said springs to permit adjustment of the initial tension on said springs.

12. A method of regulating the operation of a damper assembly employed to control the flow of conditioned air through a supply duct comprising the steps of:

providing a signal indicative of the conditioned air supply pressure to control the position of the damper assembly within the supply duct to maintain a substantially constant volume air flow irrespective of changes in the supply air pressure;

generating a first force at the maximum constant volume flow setting to restrain movement of the damper blade assembly as the position thereof is changed in response to an increase in the supply air pressure; and generating a second force at reduced levels of constant volume flow settings, with said first and second forces being additive to further restrain movement of the damper blade assembly.

13. A method in accordance with claim 12 wherein the magnitude of the first and second forces increase in substantially direct proportion to the increase in supply air pressure.

* * * * *